US006913149B2

(12) United States Patent
Gelardi et al.

(10) Patent No.: US 6,913,149 B2
(45) Date of Patent: Jul. 5, 2005

(54) UNIT DOSE PACKAGING SYSTEM WITH MOLDED LOCKING FEATURE

(75) Inventors: John A. Gelardi, Kennebunkport, ME (US); Todd H. Huffman, Richmond, VA (US); Brad A. Jones, Chesterfield, VA (US); William R. Rigby, Midlothian, VA (US); Keshav Sharma, Richmond, VA (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

(21) Appl. No.: 10/040,775

(22) Filed: Jan. 7, 2002

(65) Prior Publication Data

US 2003/0062287 A1 Apr. 3, 2003

Related U.S. Application Data

(60) Provisional application No. 60/325,181, filed on Sep. 28, 2001.

(51) Int. Cl.[7] ..... B65D 83/04

(52) U.S. Cl. ..... 206/538; 206/528; 206/1.5; 206/462; 206/531; 221/28; 221/89

(58) Field of Search ..... 206/1.5, 262, 462, 206/469, 531, 532, 538, 539; 221/5, 25, 28, 87, 88, 89

(56) References Cited

U.S. PATENT DOCUMENTS

| | | | | |
|---|---|---|---|---|
| 4,048,051 | A | | 9/1977 | Cretz |
| 4,219,116 | A | | 8/1980 | Borkan |
| 4,372,445 | A | | 2/1983 | Keffeler |
| 4,511,032 | A | | 4/1985 | Bush |
| 4,890,742 | A | | 1/1990 | Allison |
| 5,082,137 | A | * | 1/1992 | Weinstein ..... 220/345.3 |
| 5,150,793 | A | | 9/1992 | Tannenbaum |
| 5,188,230 | A | | 2/1993 | O'Brien et al. |
| 5,244,091 | A | | 9/1993 | Tannenbaum |
| 5,248,037 | A | | 9/1993 | Kornberg et al. |
| 5,366,074 | A | | 11/1994 | O'Brien et al. |
| 5,372,253 | A | | 12/1994 | O'Brien et al. |
| 5,425,448 | A | | 6/1995 | O'Brien et al. |
| 5,701,997 | A | | 12/1997 | O'Brien et al. |
| 6,021,901 | A | | 2/2000 | Wolfe |
| 6,173,838 | B1 | | 1/2001 | Brozell |
| 6,230,893 | B1 | * | 5/2001 | Karow ..... 206/531 |
| 6,491,211 | B1 | * | 12/2002 | Evans et al. ..... 229/102 |
| 2003/0015438 | A1 | * | 1/2003 | Gelardi ..... 206/1.5 |

* cited by examiner

*Primary Examiner*—David T. Fidei

(57) ABSTRACT

A unit dose package formed from the combination of a flexible portion, preferably of paperboard, which houses unit dose materials, and a rigid molded plastic locking mechanism comprising a child resistant trigger release mechanism.

19 Claims, 11 Drawing Sheets

UNIT DOSE PACKAGING SYSTEM WITH MOLDED LOCKING FEATURE

This application claims priority of Provisional Application Ser. No. 60/325,181, filed Sep. 28, 2001. The entire disclosure of that prior filed application is herein incorporated by reference.

TECHNICAL FIELD AND INDUSTRIAL APPLICABILITY

The invention relates to a reusable, lockable unit dose packaging system that is comprised of a paperboard portion and a molded locking element. The package is easy to use yet child resistant, and is therefore suitable for packaging pharmaceuticals. It is also is durable enough to withstand repeated use including opening and closing of the locking feature.

BACKGROUND OF THE INVENTION

The concept of unit dose packaging is attractive for certain pharmaceutical applications because it conveniently allows systematic dispensing of single doses, and also enables the user to track the consumption of doses according to the prescribed schedule. A feature of such packaging is that it is sturdy enough to be opened and closed numerous times until the course of medication is completed. Examples of such packaging are described in commonly assigned U.S. Pat. No. 6,047,829 (Johnstone). The Johnstone patent relates to a unit dose paperboard package that includes an outer paperboard sleeve and an inner paperboard slide card that is lockably retained within the sleeve. The sleeve includes a plurality of side panels operatively connected to each other such that one of said plurality of side panels includes a first inner slide card releasing means, and another of said side panels includes a second inner slide card releasing means, such that the inner slide card retaining and releasing means are located substantially adjacent to said unit dose dispensing means.

Child resistance is a feature particularly desired for unit dose pharmaceutical packaging, and is mandated by the Poison Prevention Packaging Act of 1970. Guidelines are prescribed for packaging to satisfy the criteria for child resistance under the statute. For example, a child resistance (CR) rating of F=1 requires that a random sampling of the subject packages not be compromised by an age specific test pool of children at a failure rate of greater than 10%. This general guideline is designed to ensure that the package maintains sufficient integrity against tampering by children.

An objective of the present invention is to provide a reinforced unit dose package having, in particular, a durable locking feature. Another objective of the invention is to provide a unit dose packaging system that is easy to open while meeting and maintaining the desired child resistance criteria throughout its use life. These and other objectives, including the improvement of aesthetic enhancement and shipping and packaging stability are met by the various embodiments of the present invention.

SUMMARY OF THE INVENTION

The unit dose packaging system of the invention comprises a combination of elements that form a sturdy, child resistant package. In this respect, the package elements include a flexible portion comprised of a series of contiguous panels; and a rigid molded plastic locking element. The unit doses may be contained within the package interior, preferably in or on a structure such as a card, dispenser or other structural element. As used herein, "unit dose" means any discrete portion of a material that is separately contained by the package. Examples of these include blisters on a support, syringes, pouches, pillows, wrapped portions, other containment vessels or any other form in which a material may be discretely dispensed or consumed. Within each discrete apportionment, the unit dose may however also contain individual dispensable items, for example each blister on a card may contain multiple tablets.

The flexible portion may be formed of paperboard or a flexible and foldable plastic material; paperboard is preferably used. This portion of the package preferably cooperates with the molded locking element to form a rigid frame enclosed by an outer covering. In this regard, one or more panels of the paperboard portion typically are attached at least partially to the molded locking element to form the rigid frame, and additional paperboard panels are extended over the top and bottom of the frame to form the outer covering. The panels are cut to fit within the frame provided by the plastic portion, and may include one or more notches, cutouts, tabs, slots or the like to ensure precise fitting of the paperboard panels to the plastic portion. In this regard, for example, the paperboard panels forming the top of the package may include slots to allow passthrough of the locking mechanism formed into the plastic portion. The paperboard panel forming the bottom of the package may also include depression means, such as notches, cutouts, tabs, to allow manipulation of the elements of the locking mechanism within the package.

The paperboard section may be formed from any bleached or unbleached, uncoated or coated C1S or C2S paperboard suitable for packaging applications. The paperboard may also be laminated with polymeric or other materials to provide additional rigidity and tear resistance, if desired. Such laminated materials are described in commonly owned co-pending U.S. application Ser. No. 09/951,035, the disclosure of which is incorporated herein by reference. Alternatively, the paperboard portion may be replaced by another foldable substrate material such as plastic. It may also be formed from a single piece of the substrate material and folded to form the respective panels of the package or, alternatively, individual panels may be cut from the substrate material and attached to the locking element as needed to form the package.

The molded locking element comprises, as basic elements, a lock element and a lock release element. Some non-limiting embodiments of a suitable locking element are described in detail in co-pending U.S. Provisional Application Ser. No. 60/305,851, which has at least one common inventor with this application, and which is incorporated herein by reference in its entirety. In such an embodiment, the molded locking element of the package includes the rigid molded portions of the frame hereinabove described, and the locking element is molded to form a frame, a slidable locking tongue and a locking flap.

The frame portion of the locking element is comprised of panels perpendicularly connected to form a polygonal package frame and a frame base which is partially cut away to accommodate the elements of the slidable locking tongue. In addition to housing the slidable locking tongue, the frame base additionally provides support and rigidity to the package. However, it is not necessary that the frame base be formed as a contiguous uncut panel; rather it may be molded to provide only the framing elements, thus eliminating package weight and reducing material cost while at the same time providing necessary support to the more flexible elements of the package. The frame base is attached by adhesive, mechanical or other means to at least one panel of the paperboard portion. In one embodiment, the molded polygonal frame is rectangular; in which case it includes two end panels that are shorter in height and of lesser length than the remaining two side panels. One of the panels of shorter height and lesser length preferably is positioned at one end of the frame and provides a support and point of attachment for the locking flap, while the other is positioned at the other end of the frame opposite the locking flap. The two side panels that complete the rectangular frame are moldably attached perpendicularly to the end panels. Each end of the side panels is extended slightly beyond the point of attachment to the corresponding end panel, such that each end of the side panel forms a ledge for supporting the overlapping end panels of the paperboard portion. In this respect, the paperboard portion may be retained beneath the ledges and the paperboard package cover is thus kept closed even if the locking mechanism is not engaged. This feature represents one safety advantage of the invention. Additional side or end panels may be included in the frame to provide additional structural support.

In addition to the end panels and the side panels, a slot housing panel is interposed between the side panels and above the frame base. This panel includes a slot for receiving and engaging a tab dependent from the locking flap and is molded at a thickness sufficient to elevate it above the frame base and thus allow engagement of the locking tongue on its underside. The height of the slot housing panel also provides support to the locking flap when the package is being closed.

Housed within the frame base is a slidable locking tongue, which functions in concert with the locking flap and the slot housing panel to close and secure the package. The locking tongue is terminated at one end by a pull ring. The other end of the locking tongue is integrally connected to a curved dowel having an upwardly protruding edge from which is extended a lateral tab positioned outermost to the curved dowel. This lateral tab is engageable with the dependent tab portion of the locking flap when it is inserted into the slot housing panel. The curved dowel is preferably held in place by a pair of stops molded in the slot housing panel. In the molded position, the curved dowel and tab are housed beneath the slot housing panel. The slidable locking tongue may be molded as a single unit from a bendable plastic material, however the curved dowel, which functions to promote movement of the bar upon manipulation of the pull ring, may preferably be formed of a plastic that is more flexible than the material used to form the frame or other elements of the locking element.

A trigger mechanism is used to de-activate the locking mechanism, which assumes a locked configuration in the molded, untensioned position. In this respect, the trigger mechanism may be a pull ring, a lever or rod, for example a T-shaped lever. In one preferred embodiment, the trigger mechanism is a circular pull ring. When the ring is pulled, the tongue is moved to withdraw the curved dowel and the lateral tab from beneath the slot housing. Movement of the locking tongue in the pull direction is intentionally limited by a pair of stops positioned in the frame base at a distance apart from the pull ring, and by a stop ledge placed horizontally across the bar to engage the stops. The stop ledge is additionally configured to extend across and beyond the width of the bar, thus keeping the bar and pull ring positioned in the same plane as the frame base.

The locking flap is connected to one end panel of the molded package frame by a hinge mechanism. Preferably, this mechanism is in the form of a living hinge that is molded together with the locking flap. Optionally, the locking flap may include finger grips to permit easy access by the user. A dependent tab is attached to one end of the locking flap, preferably near its center region. The dependent tab includes a slot corresponding with the lateral tab attached to the locking tongue. The locking mechanism is secured when the dependent tab is engaged within the slot housing and the lateral tab engages the slot within the dependent tab.

The paperboard portion of the package is affixed to the molded plastic portion by any suitable means. Where the package of the invention is used to hold unit dose materials such as pharmaceuticals, medicaments, nutritional supplements, etc., a unit dose containing element may be included within the package interior. Other consumable goods and a wide range of materials may also be packaged using this type of container if dispensing of discrete amounts is required. Such elements may be selected from blisters, pouches, pillows, foil inserts and other containment vessels, all formed by conventional means, and may be attached to the paperboard portion that forms the package or on a card inserted as a separate storage element within the container. For example, where a blister card is incorporated into the package, the blister card may be formed as one or more extensions of the paperboard panel forming the top, bottom and sides of the package.

Child resistance is provided, in part, by activating the secure locking feature described herein. To close the package, the paperboard portion is extended over the frame base and pressure applied in the region of the dependent tab of the locking flap to engage the tab with the slot in the a lot housing panel. As the dependent tab is engaged within the slot, it slides past the protruding lateral tab to snap fit into place. In the fully locked position, the lateral tab exerts a positive force against the side of the dependent tab thus making it difficult to remove the dependent tab without applying a moderate amount of pressure to disengage the lateral tab. The fully locked position represents the position in which the locking element is molded.

A more dexterous method is required to open the package. The lateral tab must be disengaged in order to withdraw the dependent tab from the slot housing panel. In this respect, the user's finger engages the pull ring at the bottom of the package, pulling the ring in the direction opposite the locking flap. The ring pulls the locking tongue and, in turn, the curved dowel outward from the slot housing panel. The positive contact between the lateral tab and the dependent tab is withdrawn, and thus the dependent tab may freely be removed from the slot housing panel. The locking flap may then be rotated about the living hinge to release the cover or top panel of the package. In various embodiments, the pull ring may be concealed on the exterior of the package by the bottom paperboard panel. In this construction, a slot is provided in the paperboard panel to allow operation of the pull ring. In other embodiments, a cutout may be provided in the bottom side panel that provides unfettered access to the pull ring. Once the locking flap is released, the unit dose containing portion, e.g. a blister card, may be unfolded to permit removal of the doses.

As an additional security feature during opening, the locking flap may be partially trifurcated into three segments by a pair of slits near the innermost edge of the locking flap. Each segment so formed is capable of some limited movement in relation to the adjacent segment. To open the package, at least one segment must be gripped and pulled outward from the package while the locking tongue is withdrawn from the slot housing panel to successfully open the locking flap.

The invention further comprises a method of packaging unit dose materials comprising:

a) forming a locking element from a rigid plastic material and a flexible plastic material; the locking element comprising a lock element and a lock release element;

b) cutting a blank from a flexible paperboard or plastic material;

c) folding and attaching the blank to the locking element; and d) inserting one or more doses of a unit dose material within the container.

DETAILED DESCRIPTION OF THE PREFERRED EMBODIMENTS OF THE INVENTION

Figure 1:
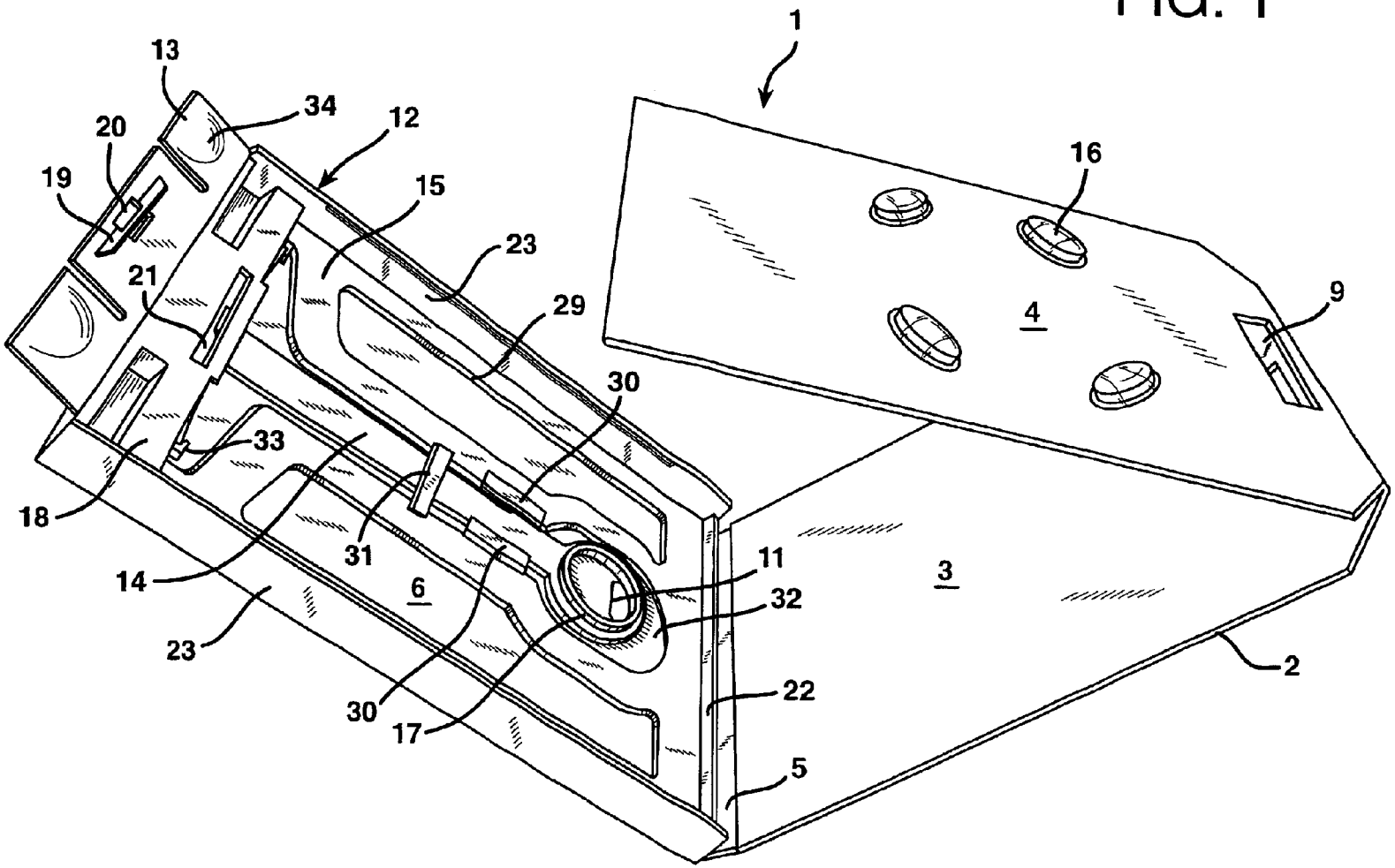
FIG. 1 is an isometric view of a partially opened unit dose package according to the invention.

As shown in FIG. 1, a combination paperboard/plastic unit dose package according to the invention in one embodiment comprises a paperboard portion 2, which in turn comprises a top panel 3 and an extension 4 that houses unit dose blisters 16 thereon. The top panel 3 is foldably connected to an end panel 5, which forms the spine of the fully formed package. A bottom panel 6 is attached to a molded locking element 12. Panel 6 includes, in this embodiment, a slot 11 cut to provide a movable region over a part of the molded portion. In other embodiments, a cutout exposing elements of the plastic portion may replace the slot 11. The paperboard portion 2 is attached by glue or hot melt adhesive to a molded plastic portion 12. Other attachment means may be used. Plastic portion 12 comprises a locking flap 13, a locking tongue 14, and a frame base 15. Frame base 15 further comprises end panels 22 and side panels 23, which are connected perpendicularly to form a rectangular frame defining the shape of the package 1, and a slot housing panel 18 having a slot 21 for engaging the locking flap 13 and a having a hollow area thereunder (not shown), in which a curved dowel portion 27 of the locking tongue 14 is stationed. Alternatively, double panels may not be used, and instead the blister packaging material is attached directly, by sealing or other known means, to a single panel of the blank. In an alternative embodiment, exemplified in FIG. 8, the frame base 15 may include a series of end panels at the end of the package 1 opposite the locking flap.

Figure 2:
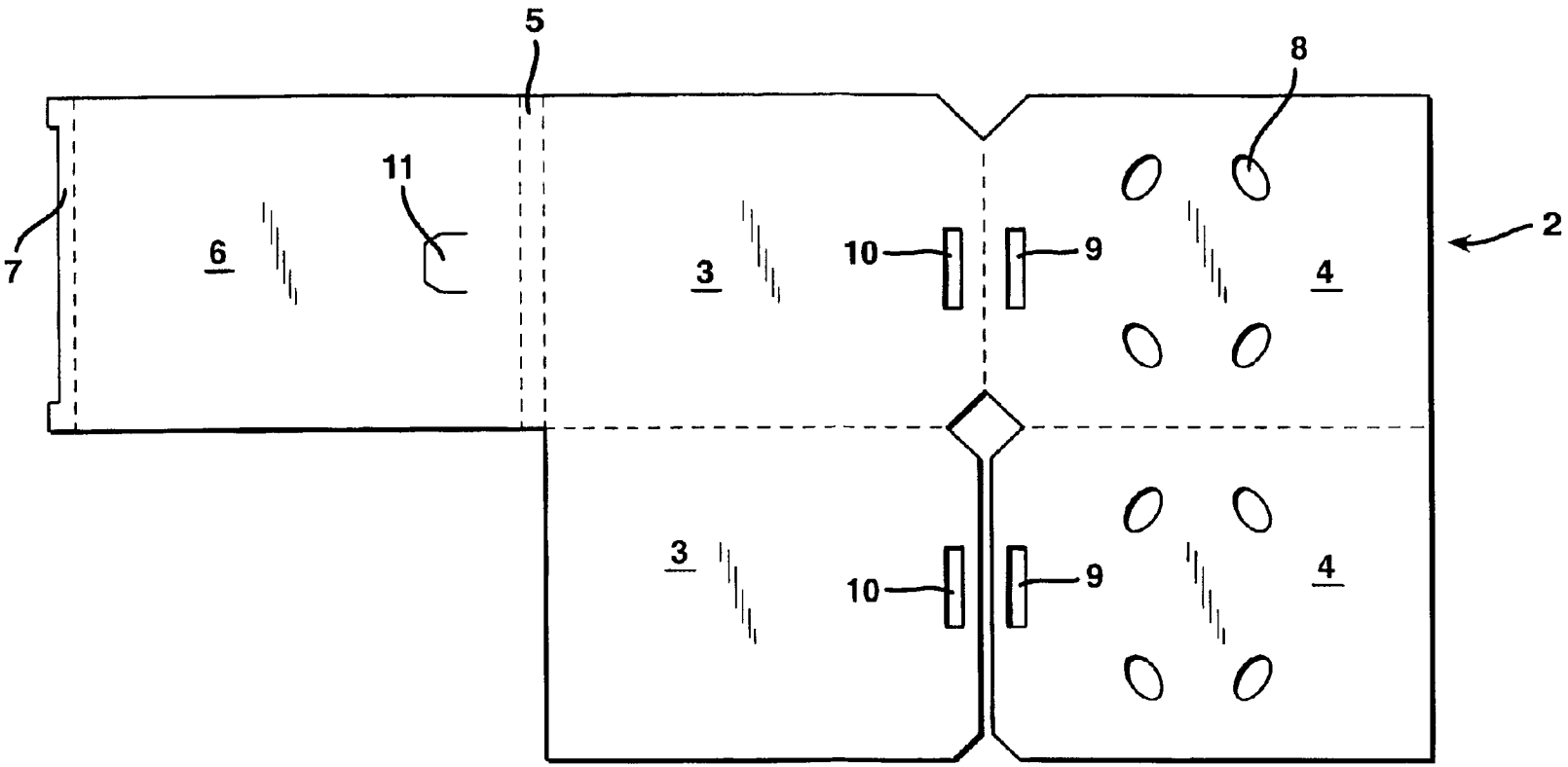
FIG. 2 is a fully extended two-dimensional view of the blank forming the paperboard portion of the package.

As shown in FIG. 2, the paperboard portion 2 is preferably formed as a top panel 3 and an extension panel 4. As shown, top panel 3 and extension panel 4 are formed from doubled panels of the chosen substrate material. The double panels provide additional physical support to the package. In addition, blister-packaging material such as a laminate or foil sheet may be interposed between the doubled panels 4 to form unit dose blisters. In use, the extension 4 is opened outward away from the top panel 3. Accordingly, both the interior and exterior surfaces of the top panel 3 and extension 4 may be printed with text or graphics, for example dosage instructions. Panels 3, 4 further include slots 9 and 10, which are positioned and sized to correspond when the double panels are folded together. The slots so formed allow dependent tab 19 of the locking mechanism to pass through the top panel 3 and extension 4 when the package 1 is closed. As mentioned previously, the blank may be modified to eliminate the use of double panels, or may be provided in multiple parts, e.g. a two-piece blank.

Figure 3:
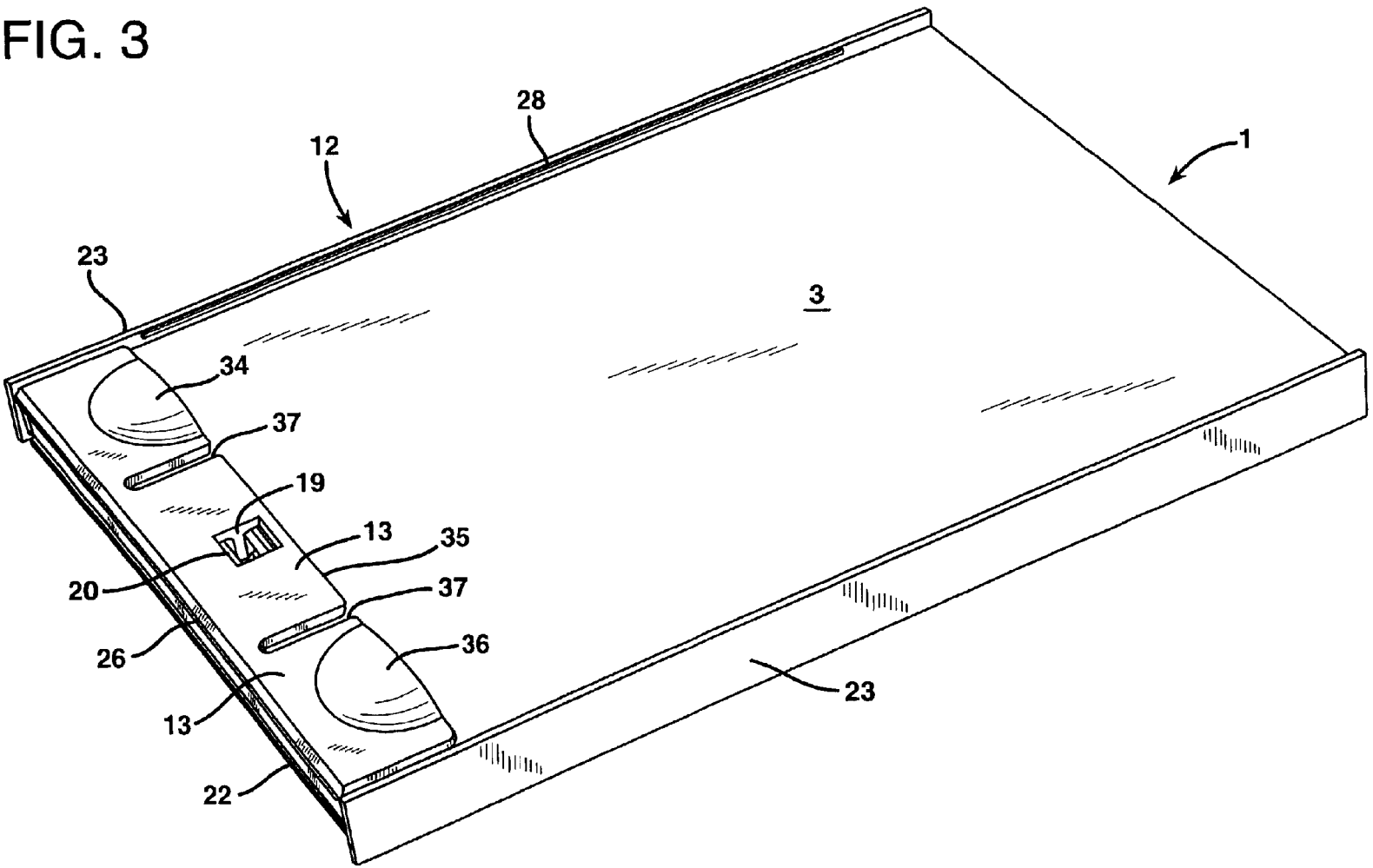
FIG. 3 is an isometric top view of the closed package.

A top view of the closed package is shown in FIG. 3. When the package is completely closed, top panel 3 is folded toward the interior of the package and folds underneath locking flap 13. Panel 3 is held in position by ledges 28 located near the edges of side panels 23. When the panel 3 is pressed downward, its edges are pressed beneath and positively engaged by the ledges 28 and are thus retained in position. Locking flap 13 is trifurcated by a pair of slits 37, which divide the locking flap 13 into segments each having a limited range of movement in relation to the adjacent segment. Ovoid finger grips 34, 36 are in this preferred embodiment molded at either end of the flap 13. In other embodiments, the grips may be curved, angled or ribbed. Dividing the flap 13 into segments may enhance the safety feature, in that to open the package, the user must pull at least one segment while engaging the pull ring 17 to move the locking tongue 14 from the untensioned position. If the ring 17 is not engaged, when the user grasps only one finger grip 34 without pulling the other finger grip 36 or the flap edge 35, the segment in the region of the grip is slightly displaced, the applied tension remains localized around the grip 34 rather than being exerted against flap edge 35, as is necessary to disengage the locking flap 13 from the slot housing 18, and the package will not readily open. A slot 20 in the middle segment of locking flap 13 is located directly above dependent tab 19, which protrudes downward beneath the plane of the locking flap 13 to engage the locking tongue 14.

Figure 4:
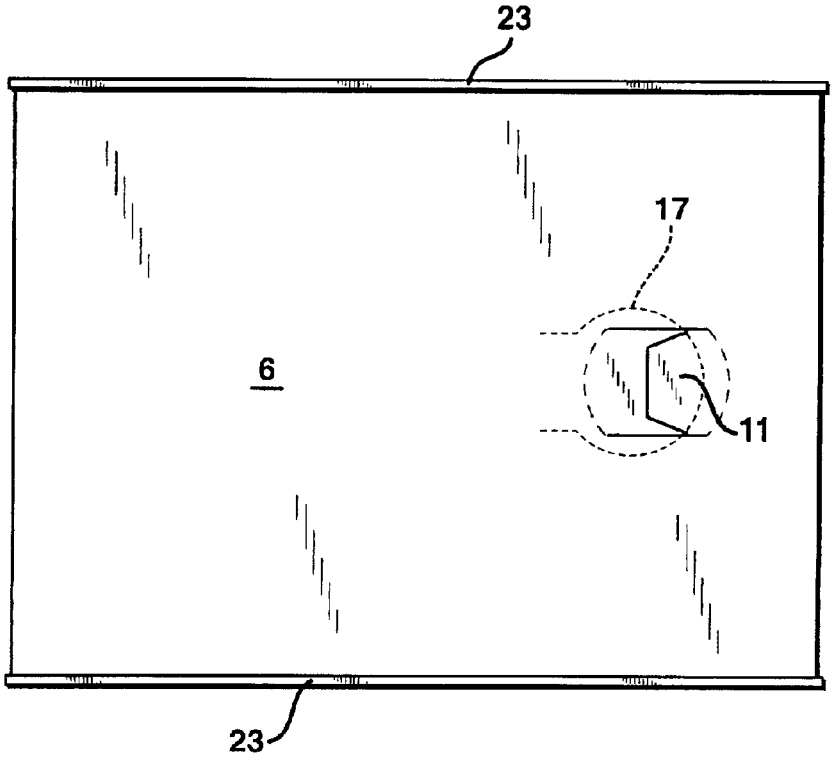
FIG. 4 is a planar view of the exterior rear of the package showing the location of the release mechanism beneath the exterior paperboard panel.
Figure 5:
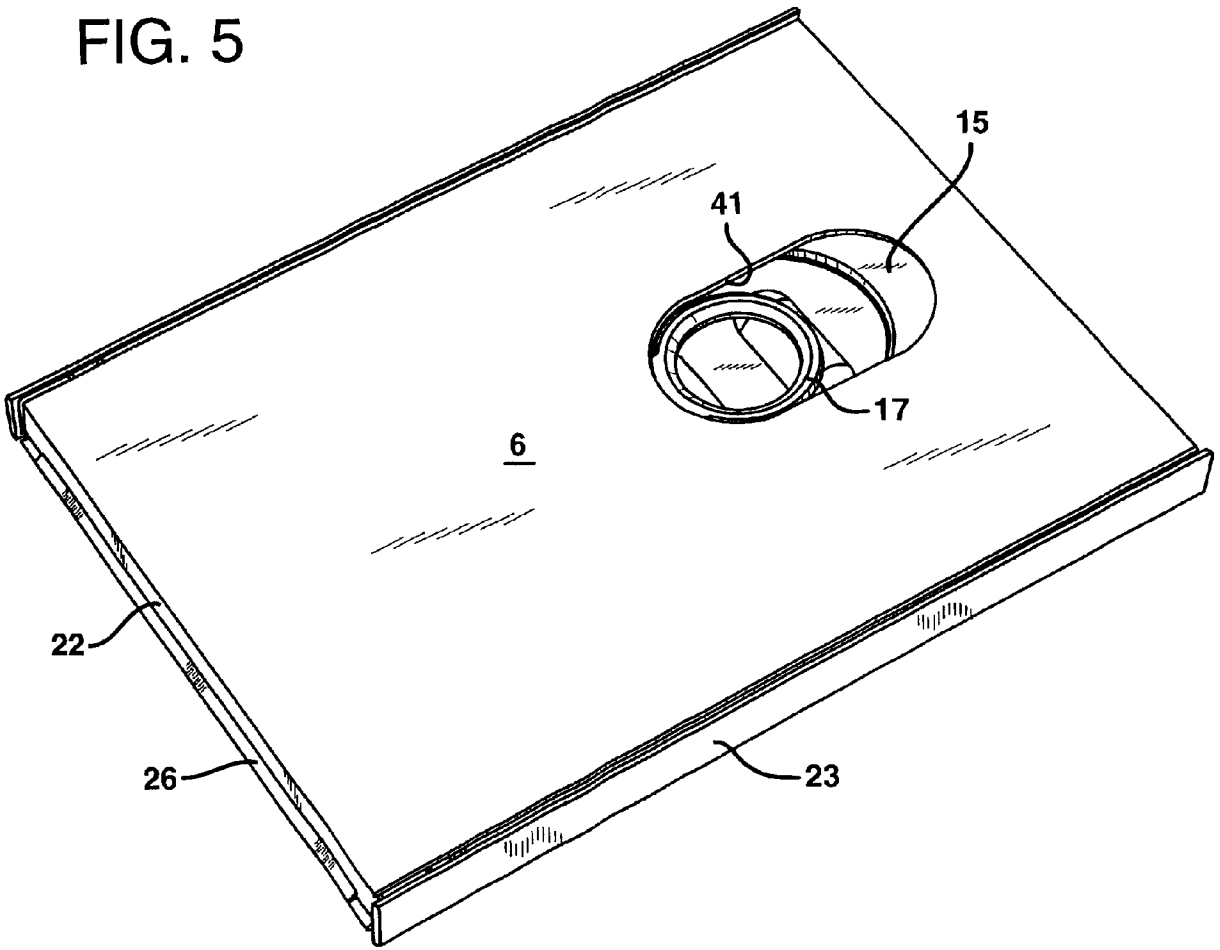
FIG. 5 is an isometric view of the exterior rear of the package with a cutout over the trigger release mechanism.

The underside or bottom of the package 1, as represented in FIG. 4, presents a paperboard panel 6 on the exterior surface. The panel 6 abuts the bottom plane of the frame base 15 and is held in place by adhesive means, or by engagement with ledges on side panels 23, as previously described, or both. A depression means is included in panel 6 to allow operation of the trigger mechanism beneath. In the embodiment shown, an angled notch is cut to form a node 11 in the panel 6 above pull ring 17. The unattached node 11 may be depressed, thus enabling the user to grasp and displace the pull ring 17 from the exterior of the package 1. In another embodiment, shown in FIG. 5, the node 11 may be eliminated and a cutout 41 formed to partially or completely expose the pull ring 17. Concealment of the pull ring may add incrementally to the child resistance characteristics, however, because the means of opening is less apparent.

Figure 6:
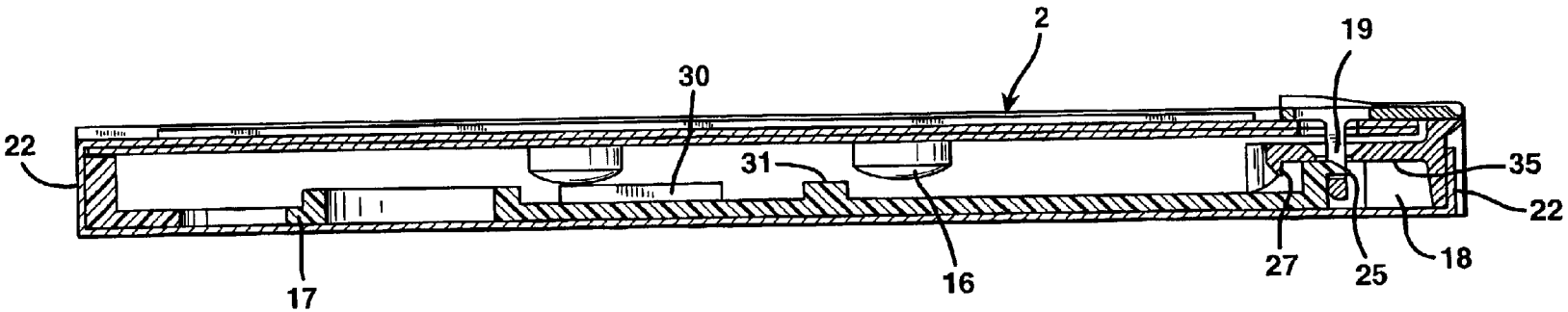
FIG. 6 is a transverse section through a closed unit dose package according to the invention.

FIG. 6 is a transverse section of the closed package showing the internal position of the blisters 16 containing unit doses in relation to the locking mechanism. Preferably, the package dimensions are such that the blisters 16 may be stored internally without being compressed by the locking mechanism elements, in particular the frame base 15, stops, 30, stop ledge 31 and the pull ring 17, which protrude to some degree above the plane of the bottom panel 6.

Figure 7:
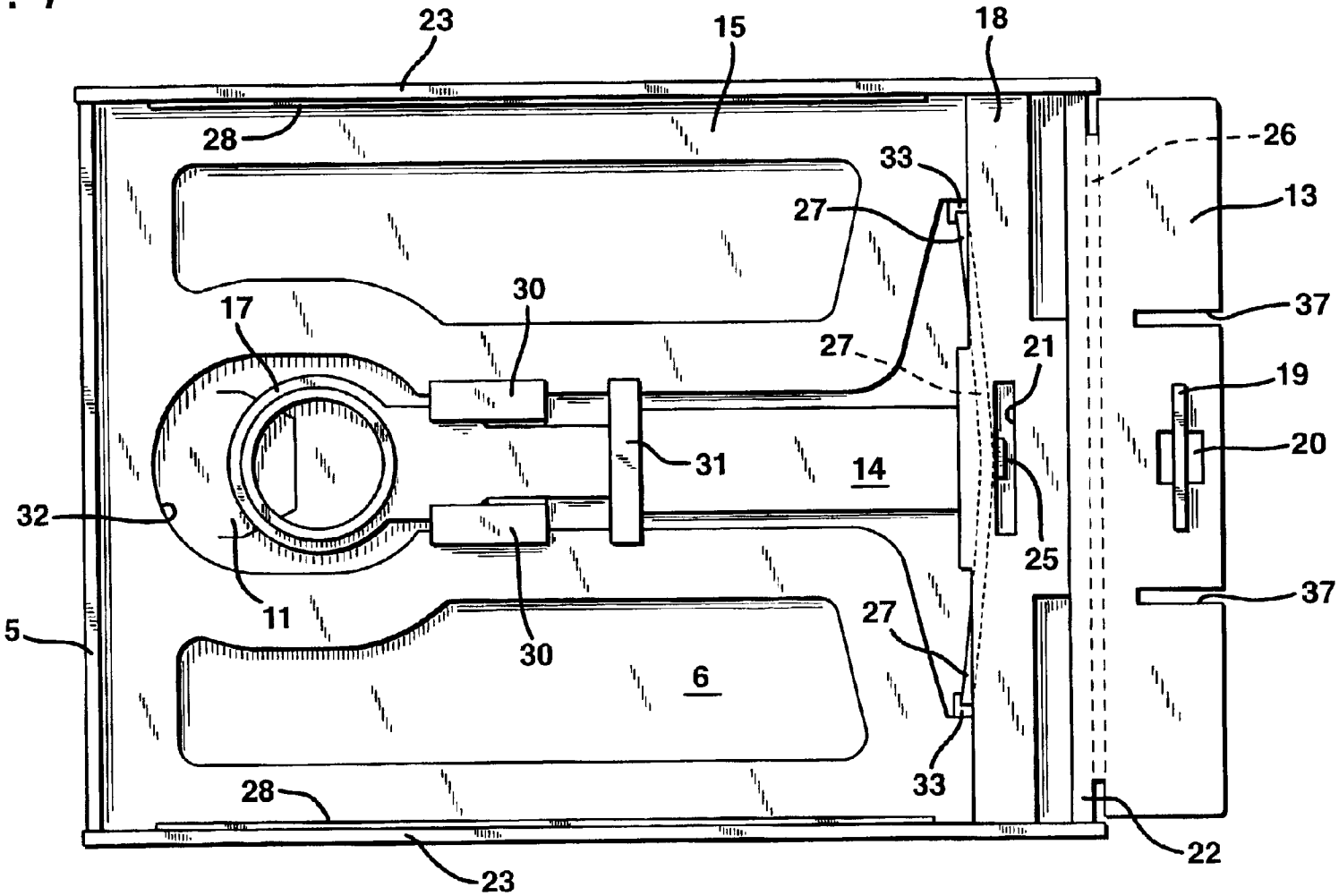
FIG. 7 is a planar view of an opened package with the top panel removed to show the elements of the molded plastic locking mechanism.

The opened package with the panels 3 and 4 removed to reveal the locking element is shown in FIG. 7. The locking element is comprised of locking flap 13, a frame base 15, a pull ring 17, which is integrally formed with and attached to a locking tongue 14, and a slot housing panel 18. The pull ring 17 is sized to accommodate a typical user's finger and is placed within a cutout 32 that is spaced to allow movement of the pull ring 17. The locking tongue 14 terminates in a curved dowel 27 made of a flexible material, which is fixedly attached to the frame base 15 at attachment points 33. Towards the center region of the curved dowel 27 is located a lateral tab 25, which protrudes outward from the end of the locking tongue 14 parallel to the frame base 15. The locking tongue 14 is in cooperation with a pair of stops 30 and a stop ledge 31, which is engageable with stops 30 to limit the movement of the tongue 14 and to prevent its dislocation out of the plane of the frame base 15.

The locking flap 13 is comprised of a dependent tab 19, which is perpendicularly placed in relation to the flap 13, and a slot 20 positioned over the tab 19. The flap 13 is further divided into segments by slits 37. The flap 13 is attached to the frame base by a living hinge 26, which is molded together with the other elements of the locking mechanism, and is disposed toward the closed position. The dependent tab 19 corresponds with a slot 21 located in a slot housing panel 18, which is adjacent and partially connected to end panel 22 within the package frame.

Figure 8:
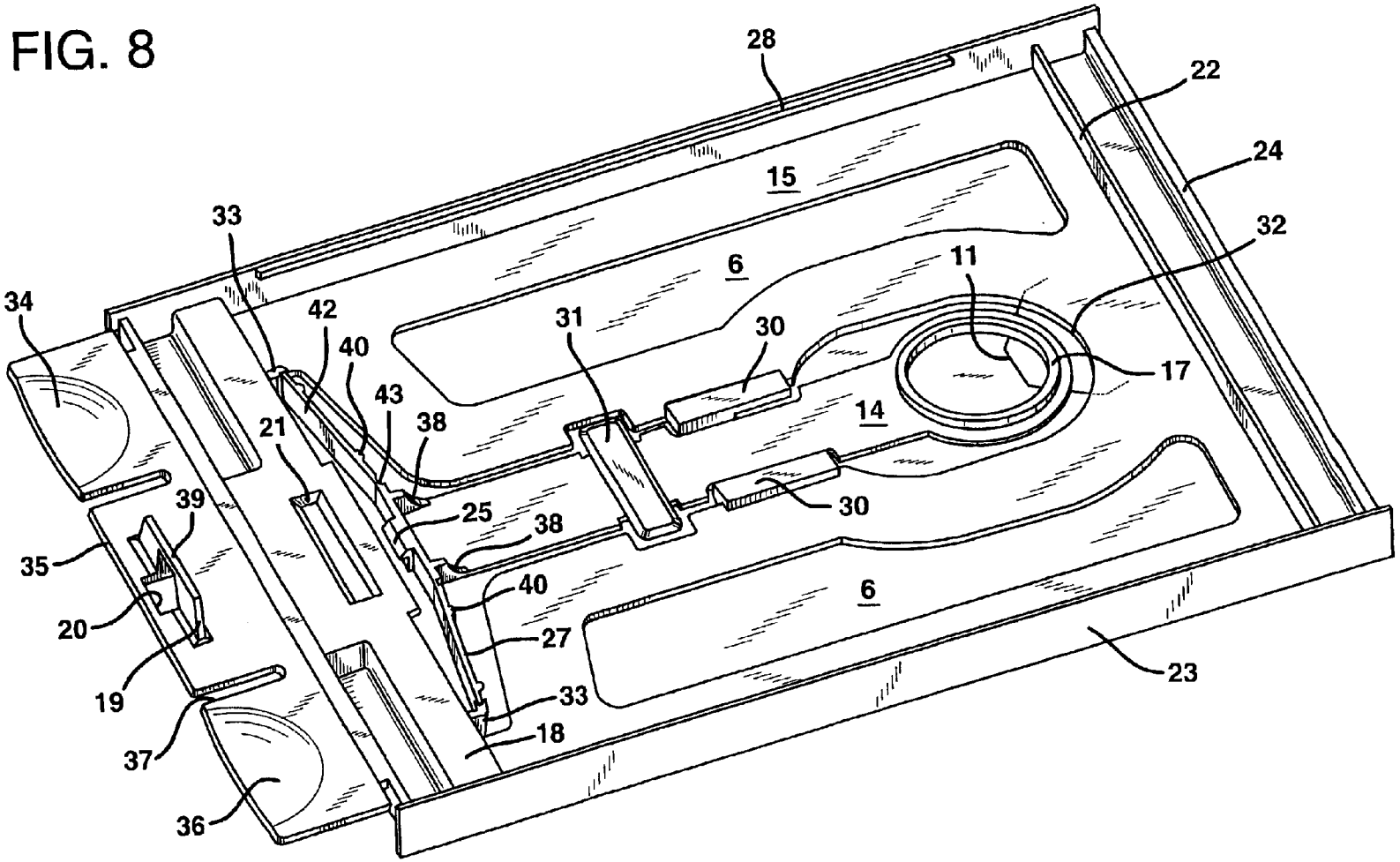
FIG. 8 is an isometric view of the package showing an alternate configuration of the package frame.

FIG. 8 displays an alternative embodiment of the molded frame of the package 1, in which multiple end panels 22, 24 of approximately the same dimensions may be placed parallel but spaced apart from each other at the end forming the package spine. These multiple panels provide additional support to the package frame. FIG. 8 also depicts the curved dowel 27 of the locking tongue 14 which, as shown, is molded to include the lateral tab 25. The curved dowel 27 is in turn fixedly attached to the molded frame base 15 at attachment points 33. The flexibility of the curved dowel facilitates movement of the locking tongue 14 in relation to the supports 38 and the frame base 15. The flexible part of the curved dowel 27 is formed as sections 42 having ridges 40 molded thereon to provide reinforcement, and thinned regions 43 which facilitate bending of the sections 42 in relation to the locking tongue 14.

Figure 9:
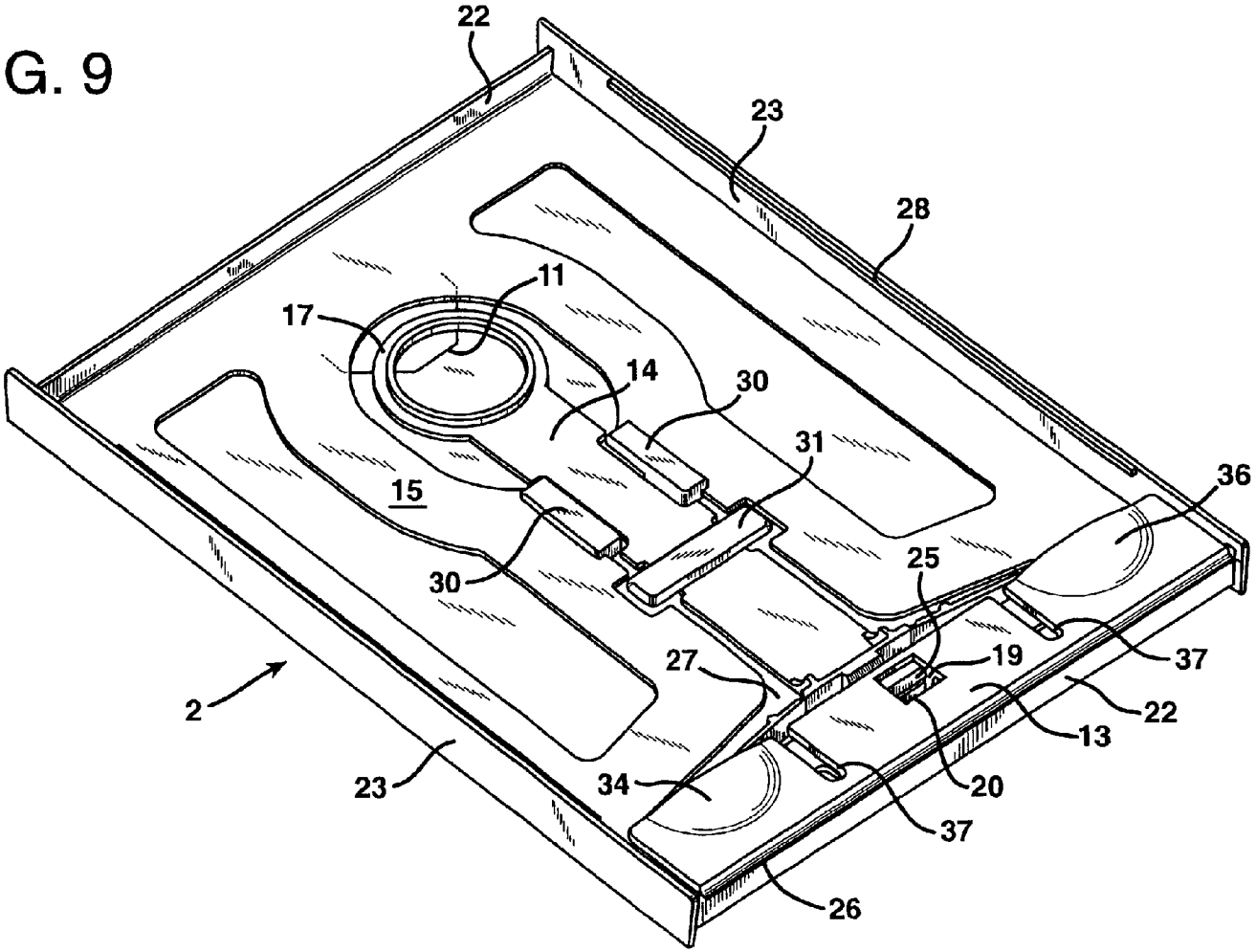
FIG. 9 is an isometric view of the package with the top panel removed to display the locking flap in the engaged, closed position.
Figure 10:
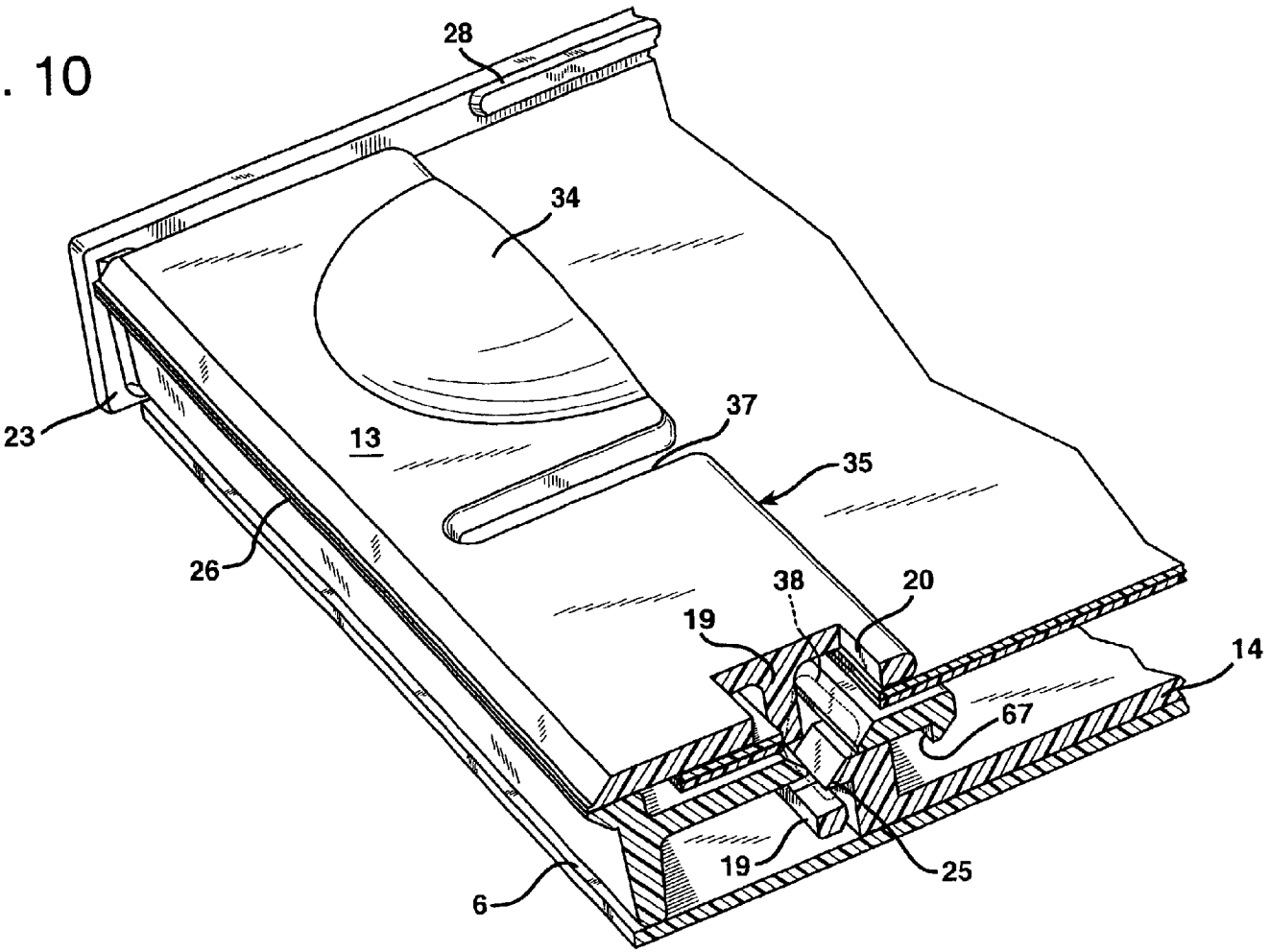
FIG. 10 depicts a transverse section of the locking mechanism showing engagement of the locking flap with the locking tongue.
Figure 11:
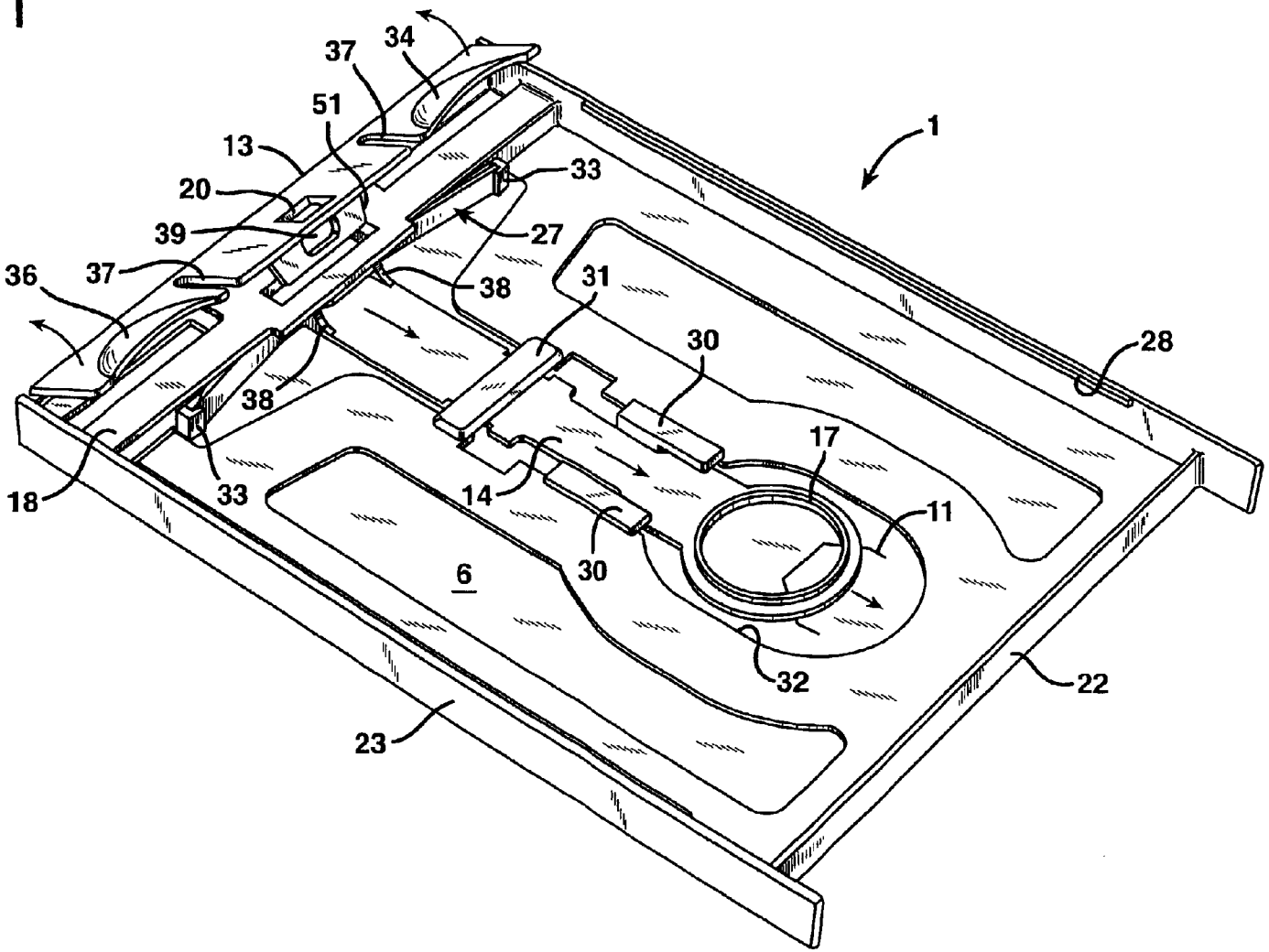
FIG. 11 is an isometric view of the package showing the operation of the locking mechanism in a partially opened package according to the invention.

FIGS. 9–11 demonstrate the operation of the locking mechanism. In FIG. 9, the package is closed (top panel removed) and the locking mechanism is in the molded, untensioned state. Curved dowel 27 is housed within the slot housing panel 18 (not shown) and the lateral tab 25 protrudes outwardly into the slot 35 of dependent tab 19. Slits 37 trifurcate the locking flap 13 into three segments, the two end segments having located thereon finger grips 34 and 36, respectively. To open the locking flap, the user must first engage the pull ring 17 and pull it outward within opening 32 away from the locking flap to withdraw the locking tongue 14, typically until the stop ledge 31 engages with the stops 30. By withdrawal of the locking tongue 14, the curved dowel 27 is withdrawn from within the slot housing panel 18.

FIG. 10 shows the engagement of the dependent tab 19, more particularly the slot 38 formed therein, with the lateral tab 25 of the curved dowel 27, in transverse section.

FIG. 11 shows the pull ring 17 activated and partially moved outward in opening 32 to withdraw the locking tongue 14. The pull ring may be activated by grasping the top and bottom of the package and inserting one finger to operate the pull ring 17. As the locking tongue 14 is withdrawn, the lateral tab 25 extending from the end thereof is withdrawn from slot 39 within dependent tab 19. While the pull ring 17 is engaged, the user simultaneously pulls one or both the finger grips 34 and 36 to withdraw the dependent tab 19 from the slot 20. If either of the finger grips 34, 36 or the middle segment is pulled without lifting the other section, sufficient tension to release the dependent tab 19 is not transferred to the middle segment of the locking flap 13 and the package will not open readily. The ease of manipulating this aspect of the mechanism may be modulated by shortening or lengthening the slits 37.

The combination package of the invention is typically formed in a machine operation in which pre-cut, pre-folded blanks are glued or heat sealed to points of attachment on the bottom of the frame base 15, end panels 5, 22 and side panels 23. Ledges present along the length of panels 23 may allow the paperboard portion to be snap fit into the molded frame formed by these side and end panels. The material for forming the blisters and the unit doses may be inserted before the paperboard portion is attached to the plastic frame, but preferably, this step is accomplished after the portions of the package are joined.

The packages of the invention are suitable for a wide range of packaging applications, and are particularly useful in the packaging of unit dose medications or pharmaceuticals where child resistance is important to prevent unwanted tampering. Without imposing any limitation as to the scope of the invention, it is noted that an advantage of certain embodiments of the invention is that it provides a package in which the contents are attached to the cover element of the package; whereas in conventional packages, the package contents are typically not attached to the cover but are otherwise contained within the package interior. It should be recognized, however, that in other embodiments of the invention, the unit dose containment means may be unattached to the cover element. Yet another advantage of the invention is that the outer panels of the cover element may be held closed within the ledges formed in the tray sides, so that the package may remain closed even when the locking mechanism is not engaged.

It is believed that the present invention includes many other embodiments, features and advantages that may not be herein described in detail, but would nonetheless be appreciated by those skilled in the art from the disclosures made. Accordingly, this disclosure should not be read as being limited only to the foregoing examples or only to the designated preferred embodiments.

We claim:

1. A unit dose package comprising a) a foldable portion formed as a series of continuous panels and comprising:

(i) a top panel having an extension foldable in relation to the top panel; the extension having included thereon one or more blisters for holding unit dose materials; and the top panel and extension panel each having one or more slots near one edge thereof:

(ii) a bottom panel foldably connected to the top panel and having a depression means located therein;

(iii) a side panel foldably connected to the top panel and the bottom panel; and b) a molded locking element disposed on said foldable portion.

2. A unit dose package according to claim 1 further comprising a unit dose containing element disposed in or on said package.

3. A unit dose package according to claim 1 wherein the molded plastic locking element comprises:

a) a pair of side panels and a pair of end panels forming a rigid rectangular package frame;

b) a frame base positioned parallel to and against the bottom panel of the paperboard portion to form a rigid tray;

c) a slidable locking tongue within the tray; said locking tongue having located at one end a trigger mechanism, and having located at the other end a curved dowel; and d) a locking flap attached to one end panel of the package frame; said locking flap comprising a dependent tab protruding downward and perpendicularly therefrom and engageable with the curved dowel;

wherein the depression means of the paperboard portion corresponds with the trigger mechanism of the molded plastic locking element;

and the slots in the top panel and the extension panel of the paperboard portion cooperate to form a slot for passthrough of the dependent tab.

4. The unit dose package of claim 3 wherein the curved dowel comprises a lateral tab protruding perpendicularly therefrom, and the dependent tab of the locking flap further comprises a slot within said tab for engagement of the lateral tab.

5. The unit dose package of claim 3 wherein the depression means is a button, notch, tab or cutout.

6. The unit dose package of claim 3 wherein the trigger mechanism is a pull ring.

7. A unit dose package according to claim 1, wherein the foldable portion is manufactured from paperboard or a foldable plastic material.

8. A unit dose package according to claim 2, wherein the unit dose containing element is selected from the group consisting of blisters, pouches and foil inserts.

9. A unit dose package according to claim 2, wherein one or more blisters are mounted on said foldable portion.

10. A unit dose package according to claim 2 wherein the unit dose containing element is attached to said foldable portion.

11. A unit dose package according to claim 10 wherein the unit dose containing element is mounted on one or more extensions of said top panel.

12. A unit dose package according to claim 2 wherein the unit dose containing element is inserted into the package as a separate element when the package is in a folded and closed configuration.

13. A unit dose package according to claim 1 wherein the molded locking element comprises:

(a) a lock element including a frame, a slidable locking tongue and a locking flap: and (b) a lock release element.

14. A unit dose package according to claim 13 wherein the frame comprises panels forming a polygonal package frame, and a frame base that is defined to accommodate the locking tongue.

15. A unit dose package according to claim 13 wherein the frame includes two side panels and two end panels connected to form a rectangular frame, the end panels being of lesser height and length in relation to the side panels; and wherein one of said end panels provides a point of attachment for the locking flap.

16. A unit dose package according to claim 13 wherein the locking tongue is terminated at one end by a pull ring.

17. A unit dose package according to claim 1 wherein the molded locking element is formed from a rigid plastic material and a flexible plastic material.

18. The unit dose package of claim 7 wherein the paperboard is formed from C1S or C2S bleached or unbleached paperboard.

19. The unit dose package of claim 7 wherein the paperboard is laminated with a polymeric material.

* * * * *